US010991479B2

(12) United States Patent
Zhao et al.

(10) Patent No.: US 10,991,479 B2
(45) Date of Patent: Apr. 27, 2021

(54) ELECTRIC POWER CABLE

(71) Applicant: Electric Power Research Institute, Inc., Palo Alto, CA (US)

(72) Inventors: Tiebin Zhao, Charlotte, NC (US); Jay A. Williams, Hilton Head Island, SC (US); Richard W. Allen, Jr., Northborough, MA (US); Frank Frentzas, Oakbrook Terrace, IL (US); Ronald J. Knapwurst, Madison, WI (US); Mohammad Anwar Pasha, Cheshire, CT (US); Mark Rogers Smith, Forest Park, GA (US)

(73) Assignee: Electric Power Research Institute, Inc., Palo Alto, CA (US)

( * ) Notice: Subject to any disclaimer, the term of this patent is extended or adjusted under 35 U.S.C. 154(b) by 0 days.

(21) Appl. No.: 16/745,777

(22) Filed: Jan. 17, 2020

(65) Prior Publication Data

US 2020/0234845 A1 Jul. 23, 2020

Related U.S. Application Data

(60) Provisional application No. 62/795,196, filed on Jan. 22, 2019.

(51) Int. Cl.

| | |
|---|---|
| ***H01B 7/00*** | (2006.01) |
| ***H01B 9/02*** | (2006.01) |
| ***H01B 7/22*** | (2006.01) |

(52) U.S. Cl.

CPC ..... *H01B 7/0009* (2013.01); *H01B 7/0072* (2013.01); *H01B 7/22* (2013.01); *H01B 9/027* (2013.01)

(58) Field of Classification Search

CPC .... H01B 9/027; H01B 9/0622; H01B 9/0627; H01B 7/0009; H01B 7/0072; H01B 7/22

See application file for complete search history.

(56) References Cited

U.S. PATENT DOCUMENTS

2004/0109651 A1* 6/2004 Lancaster ..... G01K 11/32 385/101
2011/0011639 A1* 1/2011 Visser ..... H01B 11/1813 174/350

(Continued)

OTHER PUBLICATIONS

Volker Aue, et al., *Modern Cable Systems in Steel Pipes—New designed XLPE-insulated cables substituting paper-insulated pipe type cables*, 2007, Jicable.

(Continued)

*Primary Examiner* — Timothy J Thompson
*Assistant Examiner* — Amol H Patel
(74) *Attorney, Agent, or Firm* — Curatolo Sidoti Co., LPA; Floyd Trillis, III; Salvatore A. Sidoti

(57) ABSTRACT

A cable for transmitting electricity may include a core including a first conductive material, a core shield surrounding the core, an insulation layer surrounding the core shield, the insulation layer comprising a material providing electrical insulating properties, an insulation shield surrounding the insulation layer; and at least one of the following at least partially surrounding the insulation shield: (a) a bedding layer including a first semi-conductive material, (b) a tape layer including a metallic tape intercalated with an insulating tape, and (c) a protection layer.

22 Claims, 2 Drawing Sheets

(56) References Cited

U.S. PATENT DOCUMENTS

| | | | | |
|---|---|---|---|---|
| 2015/0206629 | A1* | 7/2015 | Ona | H02G 15/1055<br>174/24 |
| 2018/0047481 | A1* | 2/2018 | Dalin | H01B 9/02 |
| 2018/0358152 | A1* | 12/2018 | Foss-Pedersen | H01B 7/0225 |
| 2019/0066873 | A1* | 2/2019 | Kaneda | H01B 7/20 |
| 2020/0043633 | A1* | 2/2020 | D'Agostino | H01B 7/0225 |

OTHER PUBLICATIONS

Anika Bosse, et al., *First 220 KV City Cable for Retrofitting of Steel Pipe Cables*, 8th International Conference on Insulated Power Cables, Jun. 23, 2011, Jicable, Versailles, France.

Dirk Bannach, et al., *Retrofitting—New high voltage XLPE cables substituting paper-insulated power cables in steel pipes*, IEEE Transactions on Power Delivery, Apr. 1998, vol. 13, No. 2.

Shoji Mashio, *Retrofitting HPFF cable*, Sumitomo Electric Industries, Ltd., 2016.

* cited by examiner

ELECTRIC POWER CABLE

CROSS-REFERENCE TO RELATED APPLICATIONS

This application claims the benefit of the filing date under 35 U.S.C. § 119(e) from U.S. Provisional Application for Patent Ser. No. 62/795,196, filed on Jan. 22, 2019, which is incorporated herein by reference as if fully written out below.

BACKGROUND

High-Pressure Fluid-Filled and High-Pressure Gas-Filled transmission cable systems make up a vast majority of the installed base of underground electric power transmission infrastructure in North America. Many of these assets are near or beyond their original design life. While many systems continue to provide reliable service for the utility industry, some failures are being reported. Load in urban areas of North America continues to grow and the growth requires greater capacity in underground transmission cable systems. In addition, manufacturing capacity of conventional paper insulated cables used for this type of underground system is decreasing. Alternatives to these types of cables are needed for future installation and replacement.

These factors compel cable users to consider new options for future system growth and enhancement. The ability to utilize the existing conduit, such as steel pipe, from the existing cable system for installation of new cables may reduce overall transmission cable project costs.

The present subject matter relates to electric power cables for installation in existing or newly installed steel pipes to provide an alternative to the existing paper insulated or laminar dielectric cables.

Options are available to install new cables into existing steel pipes. Challenges arise due to constraints of the existing steel pipe, such as pipe diameter. Several global cable manufacturers have proposed designs to overcome the challenges and commercial projects have been realized. However, the available designs use reduced insulation thickness to reduce overall cable diameter, which results in higher electrical stress across extruded dielectric cable insulation than conventionally used three-core cable designs, which may lead to shorter installation lengths when compared to single core designs; and shield designs with conventional electrical impedance that may create considerable shield losses due to induced sheath currents when the cable shield is bonded at multiple locations along the cable circuits.

What is needed are electric power cables which may provide: similar or lower electrical stress across the cable insulation as compared with conventional electric power cables; and lower shield losses to improve cable transmission capacity; as well as methods by which such cables may be more easily installed and/or retrofit into existing cable conduits.

Embodiments of the subject matter are disclosed with reference to the accompanying drawings and are for illustrative purposes only. The subject matter is not limited in its application to the details of construction or the arrangement of the components illustrated in the drawings. As used herein, "at least one" means one or more than one, and "and/or" means items listed may be included exclusively or in combination. Like reference numerals are used to indicate like components, unless otherwise indicated.

SUMMARY

Figure 1:
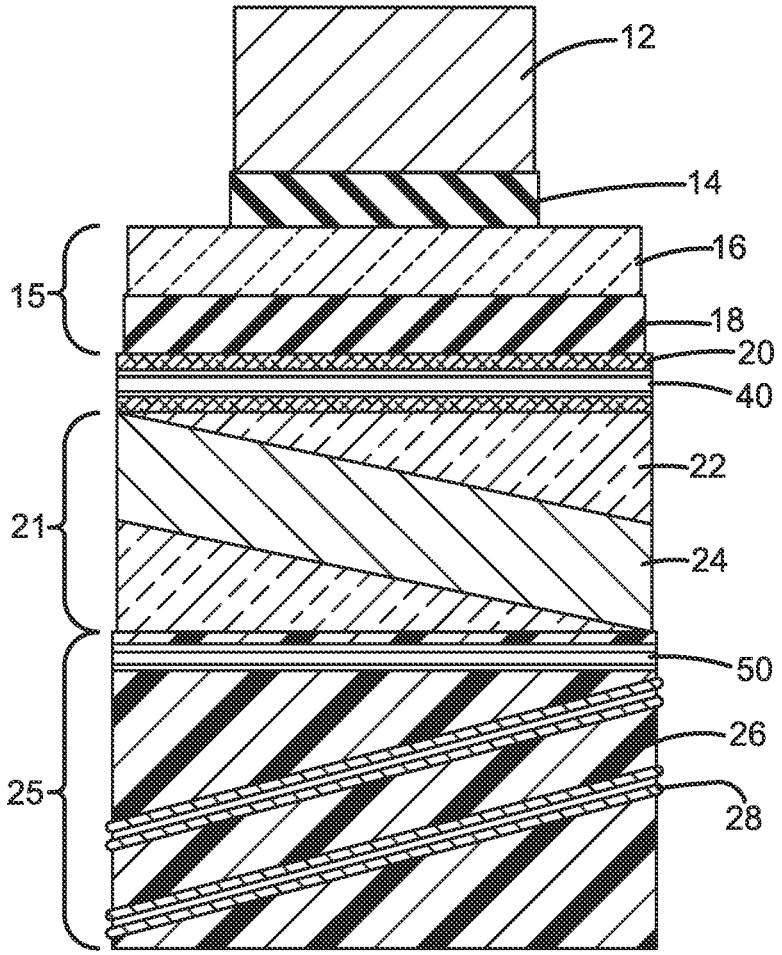
FIG. 1 is a side, cutaway view showing a cable according to the present subject matter.

Provided are electric power cables which may use a higher electrical impedance shield design than what is conventionally used for extruded dielectric cable insulation, and can use conventional extruded dielectric cable insulation thickness and therefore conventional electrical stress levels. The embodiments may lead to lower shield losses and higher overall transmission capacity. The embodiments may accommodate a single core design, by which cables may be installed and/or retrofit with longer section length into existing cable conduits relative to three-core cable designs.

DETAILED DESCRIPTION

The following embodiments of the present subject matter are contemplated:

1. A cable for transmitting electricity comprising:
   a core comprising a first conductive material;
   a core shield surrounding the core;
   an insulation layer surrounding the core shield, the insulation layer comprising a material providing electrical insulating properties;
   an insulation shield surrounding the insulation layer; and
   at least one of the following at least partially surrounding the insulation shield:
   (a) a bedding layer comprising a first semi-conductive material;
   (b) a tape layer comprising a metallic tape intercalated with an insulating tape; or
   (c) a protection layer.
2. The cable of embodiment 1, wherein the cable comprises at least two of the following at least partially surrounding the insulation shield:
   (a) a bedding layer comprising a first semi-conductive material;
   (b) a tape layer comprising a metallic tape intercalated with an insulating tape; or
   (c) a protection layer.
3. The cable of either embodiment 1 or embodiment 2, wherein the cable comprises:
   (a) a bedding layer at least partially surrounding the insulation shield, the bedding layer comprising a first semi-conductive material;
   (b) a tape layer at least partially surrounding the bedding layer, the tape layer comprising a metallic tape intercalated with an insulating tape; and
   (c) a protection layer at least partially surrounding the tape layer.
4. The cable of any one of embodiments 1 to 3, wherein the bedding layer surrounds the insulation shield.
5. The cable of any one of embodiments 1 to 4, wherein the tape layer surrounds the bedding layer.
6. The cable of any one of embodiments 1 to 5, wherein the first conductive material comprises copper or aluminum.
7. The cable of any one of embodiments 1 to 6, wherein the core shield comprises at least one semi-conducting compound.
8. The cable of any one of embodiments 1 to 7, wherein the insulating layer comprises cross-linked polyethylene or ethylene-propylene rubber, which may optionally be enhanced with nanoparticles.

9. The cable of any one of embodiments 1 to 8, wherein the insulation shield comprises at least one semi-conducting compound.
10. The cable of any one of embodiments 1 to 9, wherein the first semi-conductive material comprises a semi-conducting paper, a semi-conducting plastic, or a semi-conducting metallic tape.
11. The cable of any one of embodiments 1 to 10, wherein the bedding layer further comprises at least one fiber optic cable.
12. The cable of embodiment 11, wherein the fiber optic cable is capable of monitoring at least one of the following states of at least a portion of the cable: temperature, acoustics, or vibration.
13. The cable of any one of embodiments 1 to 12, wherein the bedding layer comprises a moisture barrier material which at least partially prevents moisture from penetrating through the bedding layer.
14. The cable of embodiment 13, wherein the moisture barrier material comprises polyethylene and/or polyvinylchloride.
15. The cable of any one of embodiments 1 to 14, wherein the metallic tape comprises at least one of stainless steel, aluminum, aluminum alloys, copper, or copper alloys.
16. The cable of any one of embodiments 1 to 15, wherein the insulating tape comprises at least one of polyethylene terephthalate, vinyl, or fiberglass.
17. The cable of any one of embodiments 1 to 16, wherein the tape layer comprises more than one layer.
18. The cable of any one of embodiments 1 to 17, wherein the tape layer does not provide moisture barrier properties.
19. The cable of any one of embodiments 1 to 18, further comprising a moisture barrier layer surrounding the bedding layer or the tape layer.
20. The cable of any one of embodiments 1 to 19, wherein the protection layer is in the form of a wire, a tape, a bar or a corrugated sheath.
21. The cable of any one of embodiments 1 to 20, wherein the protection layer comprises a second conductive material or a second semi-conductive material.
22. The cable of embodiment 21, wherein the second conductive material comprises stainless steel, aluminum, aluminum alloys, copper, or copper alloys.
23. The cable of either embodiment 21 or embodiment 22, wherein the second semi-conductive material comprises semi-conductive polyethylene.
24. The cable of any one of embodiments 1 to 23, wherein the protection layer further comprises at least one fiber optic cable.
25. The cable of embodiment 24, wherein the fiber optic cable is capable of monitoring at least one of the following states of at least a portion of the cable: temperature, acoustics, or vibration.
26. The cable of any one of embodiments 1 to 25, wherein the cable further comprises at least one water-absorbing tape layer disposed between any two or more of the other components of the cable.
27. The cable of embodiment 26, wherein the water-absorbing tape layer comprises at least one of polymer or paper tape.
28. The cable of any one of embodiments 1 to 27, wherein the core is substantially completely protected from moisture entry by at least one of the other components of the cable.
29. An electric power transmission system comprising a conduit and a plurality of cables housed within the conduit, wherein at least one of the plurality of cables is a cable according to any one of embodiments 1 to 28.
30. The electric power transmission system of embodiment 29, comprising three cables, wherein at least one of the three cables is a cable according to any one of embodiments 1 to 28.
31. The electric power transmission system of either embodiment 29 or embodiment 30, wherein each of the cables is a cable according to any one of embodiments 1 to 28.
32. The electric power transmission system of any one of embodiments 29 to 31, wherein the conduit comprises a steel pipe.
33. The electric power transmission system of any one of embodiments 29 to 32, wherein the void spaces within the conduit, outside of space taken up by the plurality of cables, is at least partially filled with a fluid.
34. The electrical transmission system of embodiment 33, wherein the fluid comprises air, nitrogen gas, water, or grout.
35. The electrical transmission system of any one of embodiments 31 to 34, wherein the conduit is pressurized to at least partially prevent ingress of outside materials or to improve the electrical strength of the insulating layer.
36. A method of assembling an electrical transmission system comprising:
providing a conduit; and
installing a plurality of cables within the conduit, at least one of the plurality of cables being a cable according to any one of embodiments 1 to 28.
37. A method of retrofitting an existing electrical transmission system comprising a conduit and at least one existing cable, the method comprising:
removing the at least one existing cable from the conduit; and
installing a plurality of cables within the conduit, at least one of the plurality of cables
being a cable according to any one of embodiments 1 to 28.
38. The method of either of embodiment 36 or embodiment 37, wherein the plurality of cables comprises three cables, wherein at least one of the three cables is a cable according to any one of embodiments 1 to 28.
39. The method of embodiment 38, wherein each of the three cables is a cable according to any one of embodiments 1 to 28.

The present embodiments are directed to a cable for transmitting electricity comprising: a core comprising a first conductive material; a core shield surrounding the core; an insulation layer surrounding the core shield, the insulation layer comprising a material providing electrical insulating properties; an insulation shield surrounding the insulation layer; and at least one of the following at least partially surrounding the insulation shield: (a) a bedding layer comprising a first semi-conductive material; (b) a tape layer comprising a metallic tape intercalated with an insulating tape; or (c) a protection layer. According to certain embodiments, the cable comprises at least two of the following at least partially surrounding the insulation shield: (a) a bedding layer comprising a first semi-conductive material; (b) a tape layer comprising a metallic tape intercalated with an insulating tape; or (c) a protection layer. According to certain embodiments, the cable comprises: (a) a bedding layer at least partially surrounding the insulation shield, the bedding layer comprising a first semi-conductive material; (b) a tape layer at least partially surrounding the bedding layer, the tape layer comprising a metallic tape intercalated with an insulating tape; and (c) a protection layer at least partially surrounding the tape layer. As used herein, "intercalated" means two or more layers wound around a substrate such that each layer and the combination of the two or more layers surrounds the substrate, preferably wherein at least one of the layers is helically wound relative to the substrate. In some embodiments, provided is a cable for transmitting electricity comprising: a core comprising a first conductive material; a core shield surrounding the core; an insulation layer surrounding the core shield, the insulation layer comprising a material providing electrical insulating properties; an insulation shield surrounding the insulation layer; a bedding layer comprising a first semi-conductive material at least partially surrounding the insulation shield; and a tape layer comprising a metallic tape intercalated with an insulating tape at least partially surrounding the insulation shield.

According to certain embodiments, the bedding layer surrounds the insulation shield. The bedding layer may be in adjacent contact with the insulation shield. In certain embodiments, a tape layer surrounds the bedding layer. According to certain embodiments, the bedding layer further comprises at least one fiber optic cable. Optional tubes or flat bars containing fiber optical cables may be included within the bedding layer for system temperature, acoustic, vibration, or other property monitoring. The fiber optic cables may be, without limitation, single mode or multiple mode fiber optic cables. The bedding layer may comprise a moisture barrier material which at least partially prevents moisture from penetrating through the bedding layer. According to certain embodiments, the bedding layer may have a thermal conductivity of about 0.26 to about 0.30 W/m·K. In certain embodiments, the moisture barrier layer surrounds the bedding layer or the tape layer.

According to certain embodiments, the bedding layer uses semi-conductive materials, which may be provided in the form of tape, such as tapes comprising polyethylene terephthalate, semi-conductive polyethylene, vinyl, fiberglass, or biaxially-oriented polyethylene terephthalate, and provides spacing for thermal expansion of the extruded insulation and mechanical protection to the cable core. The bedding tapes may then be covered by metallic tapes, such as, stainless steel, intercalated with insulating tapes, which may comprise at least one of polyethylene terephthalate, semi-conductive polyethylene, vinyl, fiberglass, or biaxially-oriented polyethylene terephthalate. The bedding tapes may be intercalated tapes of high electrical impedance, due to their material properties and extra wrapping length. Multiple layers of the tapes may be used as needed to provide extra mechanical protection to the cable core. In certain embodiments, the bedding layer comprises a first semi-conductive material, wherein the first semi-conductive material may comprise at least one of, or consist of, semi-conducting paper, polymeric tape, at least one metallic tape, or combinations thereof.

The metallic tapes may be applied helically, intercalated with an insulating tape, to offer higher electrical resistance. According to certain embodiments, a stainless steel tape of approximate 1 inch width and 0.005 inch thickness may be used, which may provide an impedance of approximately $3.6*10^{-2}$ ohms/foot, when used with a segmental copper wire conductor cable of approximately 2000 kcmil, with the conductor insulated with approximately 0.6 inch thick cross-linked polyethylene, and with three such cables installed in a single pipe. In contrast, conventional copper foil and/or associated round copper wires for a jacketed crosslinked polyethylene insulated cable have an impedance of approximately $3.7*10^{-5}$ ohms/foot. With the presence of a steel pipe as a path for line-to-ground fault currents, a low impedance/high current capability metallic shield may not be required. The circulating current losses of a multipoint shield bonded system with the use of the stainless steel tape may represent approximately 0.3 percent of the cable phase conductor losses, whereas with the copper foil, the circulating current losses of a multipoint shield bonded system may be approximately 122 percent of the conductor losses.

The bedding layer may also be designed as a moisture barrier, provided by way of example and without limitation, using moisture resistant materials to build a helically wound or longitudinally wound with an overlap layer, and those tapes may be glued or melted to prevent moisture entry. If glued or melted together, the layer after assembly should be stretchable to accept the expansion and contraction due to cable bending. The bedding layer may comprise a moisture barrier material, which may be a polymer, including but not limited to polyethylene (such as low density polyethylene, medium density polyethylene, or high density polyethylene) and/or polyvinylchloride, and which moisture barrier material at least partially prevents moisture from penetrating through the bedding layer. Bedding tapes may then be applied to account for cable radial expansion when the cable temperature increases due to loading. In certain embodiments, the bedding layer uses semi-conductive materials and provides spacing for thermal expansion and contraction of the extruded insulation when the cable temperature is changed, and provides mechanical protection to the cable core.

According to certain embodiments, the insulation shield may comprise at least one semi-conducting compound. The semi-conducting compound may comprise cross-linked polyethylene, ethylene propylene rubber, semi-conductive polyethylene, or combinations thereof.

According to certain embodiments, the tape layer may surround the bedding layer. In certain embodiments, the tape layer may be in adjacent contact with the bedding layer. The tape layer may comprise more than one winding of tape, and thereby comprise multiple layers. In certain embodiments, the tape layer does not provide moisture barrier properties. In those and other embodiments, a moisture barrier layer may surround the tape layer and/or the bedding layer, or may be disposed between and adjacent to both the tape layer and bedding layer. In certain embodiments, the tape layer may surround and/or be surrounded by a water-absorbing tape layer. The water-absorbing tape layer may be disposed adjacent to the tape layer. The water absorbing tape layer may comprise at least one of, or consist of, polymer tape, paper tape, or combinations thereof.

According to certain embodiments, the tape layer or layers may then be covered by a jacket layer made of semi-conductive material, which may be, without limitation, semi-conductive polyethylene. The tape layer or layers may protect the cable insulation from water or moisture. The tape layer or layers may be circumscribed or helically circumscribed by wires, such as stainless steel skid wires, or any other form of wires may be applied to the outside of the jacket layer for ease of installation. According to certain embodiments, the tape layer may include moisture barriers. In some embodiments, the moisture barriers of the tape layer may comprise at least one shield of high electrical impedance. The shield of high electrical impedance may be covered by a jacket layer.

According to more specific embodiments, the first conductive material of the cable core may comprise or consist of copper or aluminum. The insulation materials may be designed to accommodate higher electrical stress than used by conventional designs, to reduce the thickness of the insulation materials. Therefore, the size of the first conductive material may be maximized while maintaining the same outside diameter of the cable to increase cable circuit ampacity. Insulated-strand conductors or any other form of conductors may be used as a part of the first conductive material to further improve ampacity as needed. Higher levels of electrical stress may vary as a function of the electric power cable voltage levels (e.g., 69 kV vs 345 kV) and as a function of the electric power cable diameters, as such, specific levels for a conventional design would be appreciated by one of ordinary skill in the art as defined in, for example, the Association of Edison Illuminating Companies CS9-2015.

According to certain embodiments, the core shield may comprise at least one semi-conducting compound. The core shield may comprise, or consist of, semi-conductive polyethylene.

According to certain embodiments, the insulating layer may comprise, or consist of, cross-linked polyethylene, ethylene-propylene rubber, or combinations thereof. In some embodiments, the insulating layer may be extruded.

According to certain embodiments, the first semi-conductive material of the bedding layer comprises semi-conducting paper, at least one semi-conducting polymer tape, or at least one semi-conducting metallic tape.

According to certain embodiments, at least one of the bedding layer or protection layer further comprises at least one fiber optic cable, wherein the at least one fiber optic cable is configured to monitor at least one of temperature, acoustics, or vibration of at least a portion of the cable. The skid wires discussed above may also be configured to comprise fiber optical cables for system monitoring. According to certain embodiments, the fiber optic cables may be inside a sufficiently hollow skid wire, such as a tube, for system monitoring.

According to certain embodiments, the cable may comprise a moisture barrier layer surrounding the bedding layer and/or the tape layer. In certain embodiments, the moisture barrier layer substantially completely protects the core from moisture entry. In some embodiments, the core is substantially completely protected from moisture entry by any one, or a combination of, a moisture barrier layer, liner, conduit, or other moisture barrier materials disclosed herein.

According to certain embodiments, a metallic tape of the tape layer may comprise at least one of stainless steel, aluminum, aluminum alloys, copper, or copper alloys. The metallic tape of the tape layer may be stainless steel tape of about 5 mil thickness. The metallic tape of the tape layer may be intercalated with insulating tapes such as tapes comprising, or consisting of, polyethylene terephthalate, semi-conductive polyethylene, vinyl, fiberglass, or biaxially-oriented polyethylene terephthalate, and/or any combination of metallic and insulating tapes. The intercalated tapes may be of high electrical impedance, due to their specific material properties and helical length. Multiple layers of such tapes may be applied to provide more mechanical protection from possible indenting of the cable insulation during installation or operation, optionally providing a safety margin. At the bends of the cables, the tapes may be subjected to relative movement between layers. Sufficient overlaps between the tapes may be applied to avoid damaging the tapes during such movement and/or bending. According to certain embodiments, the tape layer is not used for sealing the cable from moisture entry.

According to certain embodiments, the protection layer may be in the form of a wire, a tape, a bar or a corrugated sheath. According to certain embodiments, the protection layer comprises a second conductive material or a second semi-conductive material. The second conductive material may comprise, or consist of, stainless steel, aluminum, aluminum alloys, copper, or copper alloys. The second semi-conductive material may comprise semi-conductive polyethylene. According to certain embodiments, the protection layer further comprises at least one fiber optic cable. In certain embodiments, the fiber optic cable is capable of monitoring at least one of the following states of at least a portion of the cable: temperature, acoustics, or vibration. The protection layer may comprise a material to reduce friction during installation. According to some embodiments, the coefficient of friction may be between about 0.08 and about 0.22.

According to certain embodiments, the cable further comprises at least one water-absorbing tape layer disposed between any two or more of the other components of the cable. The water-absorbing tape layer may comprise, or consists of, at least one of polymer tape or paper tape. In certain embodiments, the core is substantially completely protected from moisture entry by at least one of the other components of the cable.

There is therefore provided, an electric power transmission system comprising a conduit and a plurality of cables housed within the conduit, wherein at least one of the plurality of cables is a cable according to any one of embodiments disclosed herein. In certain embodiments, the electrical transmission system comprises three cables, wherein at least one of the three cables is a cable according to the embodiments disclosed herein. In embodiments, the electrical transmission system comprises three cables, wherein at least two or three cables are a cable according to the embodiments disclosed herein. According to certain embodiments, the electrical transmission system comprises a conduit comprising, or consisting of, a steel pipe. In certain embodiments, the electrical transmission system comprises a conduit including void spaces outside of space taken up by the plurality of cables, and said void spaces may be at least partially filled. In some embodiments, the void spaces may be at least partially or entirely filled with a fluid. For example, the void spaces may be filled with at least one of air, nitrogen gas, water, or grout. In certain embodiments, the electrical transmission system may include a conduit that is pressurized to at least partially prevent ingress of outside materials. According to certain embodiments, the thermal conductivity of the fluid may range from about 0.02 W/m·K to about 0.6 W/m·K, optionally from about 0.1 W/m·K to about 0.6 W/m·K. According to certain embodiments, the thermal conductivity of the fluid may be about 0.6 W/m·K.

There is also provided a method of assembling an electrical transmission system comprising: providing a conduit; and installing a plurality of cables within the conduit, at least one of the plurality of cables being a cable according to any one of embodiments disclosed herein.

There is also provided a method of retrofitting an existing electrical transmission system comprising a conduit and at least one existing cable, the method comprising: removing at least one existing cable from the conduit; and installing a plurality of cables within the conduit, at least one of the plurality of cables being a cable according to any one of embodiments disclosed herein. The method may provide that the plurality of cables comprises three cables, wherein at least one of the three cables is a cable according to any one of embodiments disclosed herein. In certain embodiments, two or each of the three cables are cables according to any one of embodiments disclosed herein.

In certain embodiments, a cable system may be provided in a steel pipe in which three cables may be installed, wherein the conduit is configured to conduct cable fault current if a cable fault occurs, wherein at least one of the cables is a cable as described herein. The conduit may also be configured as a moisture barrier, which may prevent water or moisture penetrating the pipe and degrading the cable insulation. In certain embodiments, the conduit may be maintained water-tight and optionally pressurized with dry air or nitrogen. In certain embodiments, the conduit may include cathodic protection. According to certain embodiments, the conduit may be configured to monitor the pressure of the conduit, which may include, without limitation, a gas cabinet.

According to certain embodiments, wherein the cable core is substantially completely protected from water entry, additional power transfer may be realized with the addition of at least one substance of higher thermal conductivity to the conduit. Without limitation and provided as an example, the at least one substance may include a fluid or grout.

The cables may be packed and shipped individually in three separate reels for each phase conductor respectively, which allows longer cable length on each reel relative to 3-core cable, and therefore, a longer installation length can be utilized. Cable installation may be similar to that for pipe-type cables, since the cables are packed using one cable on one reel. According to certain embodiments, a cable of the present embodiments may be pulled into pipes with lengths of at least one mile.

Pulling tensions, sidewall pressures and other aspects which would be appreciated by one of ordinary skill in the art, may be calculated based on the cable and conduit utilized. According to certain embodiments, lubricants may be used for installation in order to meet the pulling tensions and/or sidewall pressure requirements of the cable and/or conduit.

To prepare for installation, three reels with cable may be brought to the installation site and mounted in reel trailers or on reel stands for installation. The three cables may be pulled simultaneously into the conduit, which may be steel pipe. According to certain embodiments, cable joints similar to those for conventional extruded-dielectric cables may be applied. In some embodiments, the cable may be installed with three joints in one enclosure or directly within the manhole without an additional enclosure. According to certain embodiments, the enclosure may use a larger diameter to contain three joints in a parallel location. The enclosure may use a longer casing to install three joints in a staggering arrangement. Existing manholes may be utilized or may be lengthened to accommodate this staggering arrangement. According to certain embodiments, a mechanism to control the cable thermo-mechanical movements within the joint casing may be applied, wherein the mechanism provides that the cable movement force does not impact the performance of the cable joints. In certain embodiments, transition joints between conventional cable and the cable of the present embodiments may be utilized in order to accommodate installation of cable of the present embodiments with conventional cable.

According to certain embodiments, conventional cable terminations may be applied. In certain embodiments, stainless-steel riser pipes may be used, non-magnetic riser pipes may be applied, or the cables may be directly buried after they exit the conduit, a non-limiting example of which may be a carbon steel pipe via a trifurcating assembly.

In certain embodiments, the cable shield and skid wires may be bonded to the steel pipes at joint locations and grounded at the termination locations through isolator surge protectors, link boxes, or sheath voltage limiters.

According to certain embodiments, transposing three phase cables for a cable span between two adjacent manholes may be applied through a mechanism during cable pulling by exchanging cable reel positions. In certain embodiments, an alternating reel positioning can be applied twice at each one-third length of the span. In certain embodiments, transposing of phase conductors may further reduce both the induced current on the cable shield and the thermo-mechanical movement.

There is therefore, also provided a cable for transmitting electricity comprising: a core comprising a first conductive material; a core shield surrounding the core; an insulation layer surrounding the core shield, the insulation layer comprising a material providing: (i) electrical insulating properties, and optionally (ii) thermal insulating properties or thermal conductive properties; an insulation shield surrounding the insulation layer; and at least one of the following at least partially surrounding the insulation shield: (a) a bedding layer comprising a first semi-conductive material; (b) a tape layer comprising a metallic tape intercalated with an insulating tape; or (c) a protection layer. According to certain embodiments, the cable comprises at least two of the following at least partially surrounding the insulation shield: (a) a bedding layer comprising a first semi-conductive material; (b) a tape layer comprising a metallic tape intercalated with an insulating tape; or (c) a protection layer. According to certain embodiments, the cable comprises: (a) a bedding layer at least partially surrounding the insulation shield, the bedding layer comprising a first semi-conductive material; (b) a tape layer at least partially surrounding the bedding layer, the tape layer comprising a metallic tape intercalated with an insulating tape; and (c) a protection layer at least partially surrounding the tape layer.

The insulation layer may provide thermal insulating properties and/or thermal conductive properties, depending on the particular application intended for the cable. In certain embodiments, it may be desirable to maintain the core at a low temperature, in which case it may be desirable that the insulation layer be capable of conducting heat away from the core, while still providing adequate electrical insulating properties, such that the insulating layer has thermal conducting properties. In certain embodiments, it may be necessary that the insulating layer provide thermal insulating properties in order to maintain the core at a desired temperature. According to certain embodiments the minimum core temperature in is about −50° C. to about −40° C., and the temperature at rated current is about 70° C. to about 85° C. According to certain embodiments, the maximum core temperature may be as high as 105° C. According to certain embodiments, the thermal conductivity ranges from about 0.15 W/m·K to about 0.4 W/m·K. In certain embodiments, the thermal conductivity may be about 0.29 W/m·K.

FIG. 1 is a side, cutaway view showing an illustrative embodiment of a cable according to the present subject matter. Shown is a cable 10 including a core 12 comprising a first conductive material. Surrounding the core 12 is a core shield 14. According to certain embodiments, the core shield may be in adjacent contact with the core 12. Surrounding the core shield 14 is an insulation layer 15, which comprises an insulating material 16 and an insulating shield 18. Surrounding the insulating layer 15 is a bedding layer 20, which may include a first semi-conductive material and/or at least one fiber optic cable 40. Surrounding the bedding layer 20 is a tape layer 21, which may include both insulating 22 and metallic 24 tapes, wherein the metallic 24 and insulating 22 tapes may be intercalated. Surrounding the tape layer 21 is a protection layer 25 which may include a jacket 26 and skid wires 28.

The protection layer 25 may further comprise at least one fiber optic cable 50.

Figure 2:
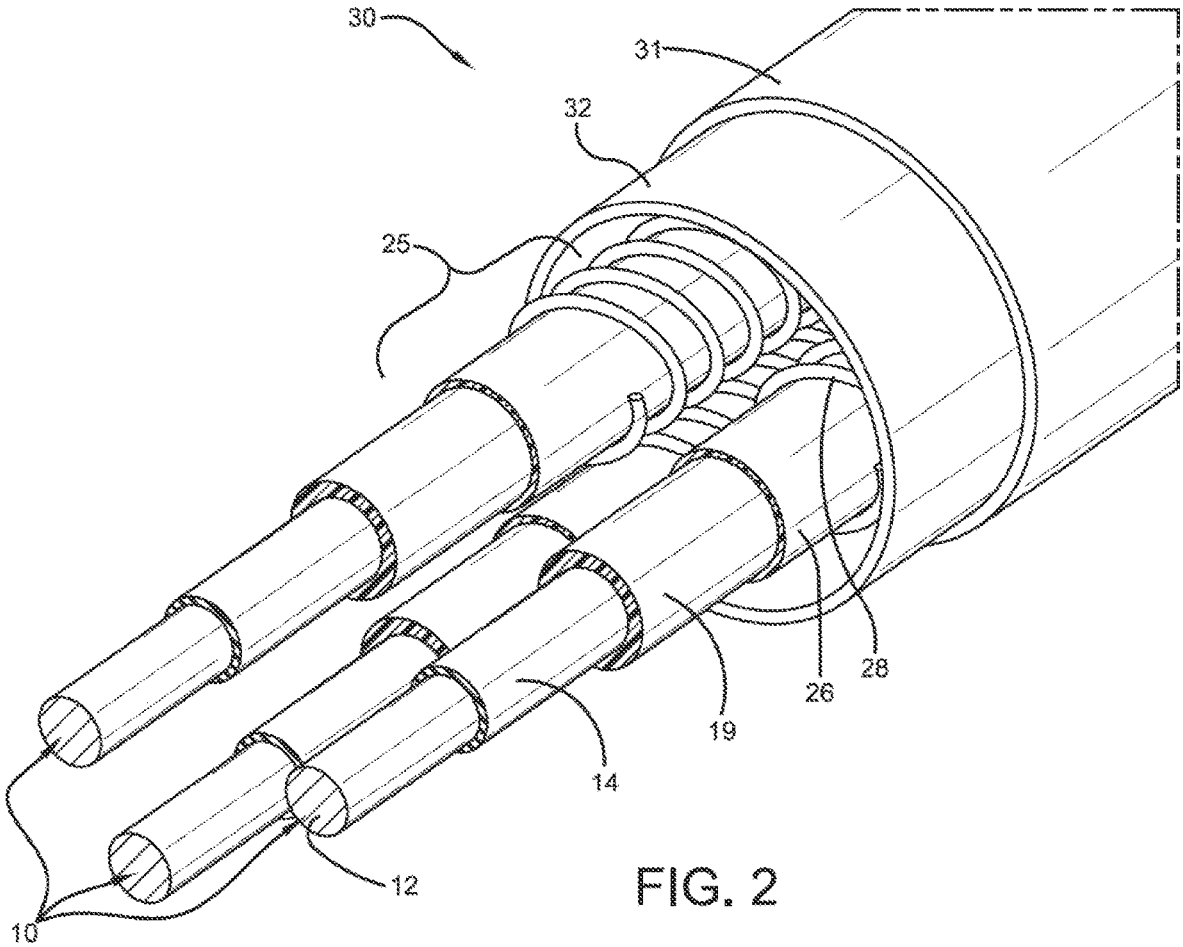
FIG. 2 is a perspective, cutaway view showing an electric power transmission cable system according to the present subject matter.

FIG. 2 is a perspective, cutaway view showing an electric power transmission system according to the present subject matter. The electric power transmission system 30 comprises a conduit or pipe 32, which may comprise, or consist of, steel, with a pipe coating 31 to protect and insulate the pipe or conduit 32. Within the pipe or conduit 32 is at least one cable 10 according to the present subject matter, including a core 12 comprising a first conductive material. The core 12 is surrounded by a core shield 14. Between the core shield 14 and protection layer 25 is an insulation layer 19. According to some embodiments, the insulation layer 19 may include a bedding layer (not shown, 20 in FIG. 1) and/or tape layer (not shown, 21 in FIG. 1). The insulation layer 19 surrounds the core shield 14, and is surrounded by the jacket 26 and skid wire 28 of the protection layer 25.

It will be understood that the embodiments described herein are merely exemplary, and that one skilled in the art may make variations and modifications without departing from the spirit and scope of the invention. All such variations and modifications are intended to be included within the scope of the invention as described hereinabove. Further, all embodiments disclosed are not necessarily in the alternative, as various embodiments of the invention may be combined to provide the desired result.

We claim:

1. A cable for transmitting electricity comprising:
- a core comprising a first conductive material;
- a core shield surrounding the core;
- an insulation layer surrounding the core shield, the insulation layer comprising a material providing electrical insulating properties;
- an insulation shield surrounding the insulation layer;
- a bedding layer at least partially surrounding the insulation shield comprising a first semi-conductive material;
- a tape layer in adjacent contact with the bedding layer comprising a metallic tape intercalated with an insulating tape, wherein the metallic tape is in adjacent contact with the insulating tape; and
- a protection layer, wherein the tape layer is also in adjacent contact with the protection layer.

2. The cable of claim 1, wherein the bedding layer surrounds the insulation shield.

3. The cable of claim 1, wherein the tape layer surrounds the bedding layer.

4. The cable of claim 1, wherein the first conductive material comprises copper or aluminum.

5. The cable of claim 1, wherein the core shield and/or the insulation shield comprises at least one semi-conducting compound.

6. The cable of claim 1, wherein the first semi-conductive material comprises a semi-conducting paper, a semi-conducting plastic, or a semi-conducting metallic tape.

7. The cable of claim 1, wherein the insulating layer comprises cross-linked polyethylene or ethylene-propylene rubber, which may optionally be enhanced with nanoparticles.

8. The cable of claim 1, wherein the bedding layer further comprises at least one fiber optic cable.

9. The cable of claim 8, wherein the fiber optic cable is capable of monitoring at least one of the following states of at least a portion of the cable: temperature, acoustics, or vibration.

10. The cable of claim 1, wherein the bedding layer comprises a moisture barrier material which at least partially prevents moisture from penetrating through the bedding layer.

11. The cable of claim 10, wherein the moisture barrier material comprises polyethylene and/or polyvinylchloride.

12. The cable of claim 1, wherein the metallic tape comprises at least one of stainless steel, aluminum, aluminum alloys, copper, or copper alloys.

13. The cable of claim 1, wherein the insulating tape comprises at least one of polyethylene terephthalate, vinyl, or fiberglass.

14. The cable of claim 1, wherein the protection layer is in the form of a wire, a tape, a bar or a corrugated sheath, optionally wherein the protection layer comprises a second conductive material or a second semi-conductive material.

15. The cable of claim 14, wherein the second conductive material comprises stainless steel, aluminum, aluminum alloys, copper, or copper alloys.

16. The cable of claim 14, wherein the second semi-conductive material comprises semi-conductive polyethylene.

17. The cable of claim 1, wherein the protection layer further comprises at least one fiber optic cable.

18. The cable of claim 1, wherein the core is substantially completely protected from moisture entry by at least one of the other components of the cable.

19. An electric power transmission system comprising a conduit and a plurality of cables housed within the conduit, wherein at least one of the plurality of cables is a cable according to claim 1, optionally wherein the conduit comprises a steel pipe, further optionally wherein the conduit is pressurized to at least partially prevent ingress of outside materials or to improve the electrical strength of the insulating layer.

20. The electric power transmission system of claim 19, wherein the void spaces within the conduit, outside of space taken up by the plurality of cables, is at least partially filled with a fluid, optionally wherein the fluid comprises air, nitrogen gas, water, or grout.

21. A method of assembling an electrical transmission system comprising:
- providing a conduit; and
- installing a plurality of cables within the conduit, at least one of the plurality of cables being a cable according to claim 1.

22. A method of retrofitting an existing electrical transmission system comprising a conduit and at least one existing cable, the method comprising:
- removing the at least one existing cable from the conduit; and
- installing a plurality of cables within the conduit, at least one of the plurality of cables being a cable according to claim 1.

* * * * *